United States Patent [19]

Jeffreys

[11] Patent Number: 4,825,772

[45] Date of Patent: May 2, 1989

[54] POURING TANK AND TRACK TRANSFER ASSEMBLY

[75] Inventor: Lyman W. Jeffreys, Barrington, Ill.

[73] Assignee: AMSTED Industries Incorporated, Chicago, Ill.

[21] Appl. No.: 514,940

[22] Filed: Jul. 18, 1983

[51] Int. Cl.[4] ..... B61F 9/00

[52] U.S. Cl. ..... 104/247; 246/465

[58] Field of Search ..... 104/1 R, 1 A, 130, 242, 104/243, 245, 247; 238/1, 17, 121, 122, 131; 246/454, 455, 465; 164/335, 437

[56] References Cited

U.S. PATENT DOCUMENTS

| | | | |
|---|---|---|---|
| 870,870 | 11/1907 | Custer | 164/335 X |
| 3,408,950 | 11/1968 | Puhringer | 246/455 X |
| 4,353,306 | 10/1982 | Rohrbach et al. | 104/247 X |

FOREIGN PATENT DOCUMENTS

| | | | |
|---|---|---|---|
| 2162738 | 6/1973 | Fed. Rep. of Germany | 104/245 |
| 167009 | 4/1934 | Switzerland | 104/247 |

*Primary Examiner*—Robert B. Reeves
*Assistant Examiner*—Frank H. Williams, Jr.
*Attorney, Agent, or Firm*—Charles E. Bouton; Edward J. Brosius

[57] ABSTRACT

A pouring tank assembly and transfer tracks are provided whereby a transfer car holding a pouring tank filled with molten metal can be rolled from a loading station to a pouring station. The transfer tracks are of a double rail configuration, with two tracks forming an angle whose vertex is at the pouring station. A third guide rail parallels each set of tracks. The transfer car is equipped with flangeless wheels which roll along the transfer tracks, and has a support arm from which guide rollers extend. Such guide rollers contact the guide rail to provide lateral stability for the transfer car.

3 Claims, 3 Drawing Sheets

POURING TANK AND TRACK TRANSFER ASSEMBLY

BACKGROUND OF THE INVENTION

The present invention relates to a pouring tank and a track transfer assembly and, more particularly, to a pair of tracks intersecting at a pouring station and a pouring tank adapted to roll along such tracks.

In the pressure casting of repetitive articles, such as railway wheels, it is desirable to be able to move a pouring tank containing a full ladle of molten metal quickly into the pouring station from which a pouring tank with an empty ladle has just been moved. Due to the gross weight of the filled pouring tank-transfer car assembly of about 75 tons (68 metric tons), it is desirable to move the cars into and out of the pouring station over rails. However, for increased speed in moving out the empty car it is best to move the empty car out of the pouring station over one set of rails and move the filled car into the pouring station over another set of rails. To best utilize plant space and to provide for crane transfer of filled ladles into the pouring tanks and pouring tank cover and tube placement and removal, it is best if the pouring tank-transfer car assemblies are moved to loading stations which are not greatly physically removed from each other. Accordingly, an angled track arrangement for the transfer of such cars into and out from the pouring station is desirable. A single pouring station is required because of the nature of the bottom pressure pouring operation wherein the pouring tank is pressurized and molten metal is injected upwardly into the molds above. This further facilitates the assembly line movement of molds into and out of the pouring station along roller conveyors.

However, in the angled intersection of the traditional railroad type rail, it is necessary to provide a turntable wherein a section of track is rotatable from the one set of tracks to the other. For example, the empty tank is rolled out along the first set of tracks, the turntable is rotated to the other set of tracks to bring in the filled tank. This is an undesirable method as the mechanical turntable is a frequent source of breakdown. Alternatively, a frog type junction in the intersecting rails can be provided wherein the two intersecting sets of tracks have gaps at the intersection of each rail. Such gaps are necessary to permit the passage of the flanged wheels on the transfer car through the intersection. Such an arrangement is undesirable due to the bumping that the heavy, molten metal filled car receives when its wheels roll over such gaps. Finally, a railroad switch type arrangement could be employed to switch between each set of tracks. This would be undesirable for both reasons discussed herein, namely, the possibility of mechanical breakdown of the switch and gaps necessary between switched rails.

Accordingly, it is an object of the present invention to provide a pouring tank transfer car and a track arrangement for such car.

SUMMARY OF THE INVENTION

The present invention provides a track arrangement which permits the rapid removal of a pouring tank-transfer car assembly from a pouring station and the movement of a filled pouring tank-transfer car assembly into the pouring station. The invention also provides a pouring tank-transfer car assembly adapted for use on such tracks.

The track arrangement of the present invention includes a first set of two parallel rails with a third guide rail parallel thereto. A second set of two parallel rails is also provided with a third guide rail parallel thereto. The first and second sets of rails are positioned as legs of an acute angle whose vertex is at the pouring station. The individual tracks cross or intersect without gaps. The X-shaped intersections of the individual rails permit a transfer car to be rolled over either set of tracks into and out of the pouring station. However, the pouring tank transfer car that is rolled over said tracks must have flangeless wheels in order to pass over the track intersections. As discussed above, flanged wheels would keep the transfer car on the two rails due to the flange contact on the inside and/or outside of the rails, but the presence of the flanges would require the track intersections to have gaps to permit the flanges to pass therethrough. However, the flangeless wheels of the present invention would not provide lateral stability for the transfer car on the two rails. Accordingly, a third rail is provided for each set of rails parallel to such rails. A support extends from the transfer car and includes a roller set or other suitable guide means such as sliding shoes that is adapted to engage such third rail. In such manner lateral stability for the transfer cars is provided without the need for flanged wheels on the transfer cars.

The support extending from the transfer car usually comprises a beam type member extending from the frame of the transfer car. The beam member usually has two rollers extending downwardly therefrom, said rollers being spaced so as to form a receiving space for the third or guide rail. The two rollers contacting either side of the guide rail provide lateral stability for the transfer car on the support rails.

In particular, the present invention provides a track assembly for use in the transfer of pouring tanks comprising a first set of parallel rails extending from a first loading station to a pouring station and a first guide rail paralleling the first set of rails, and a second set of parallel rails extending from a second loading station to said pouring station and a second guide rail paralleling the second set of rails, wherein individual rails of said first and second sets of rails cross in one or more locations near said pouring station, all such rail crossings being abutted without gaps, and said guide rails do not intersect each other or either set of rails.

The present invention also provides an assembly comprising a first set of parallel support rails and a first guide rail paralleling said first set of parallel support rails, a second set of parallel support rails and a second guide rail paralleling said second set of parallel support rails, said first and second set of parallel support rails intersecting at one or more locations, a transfer car having two sets of parallel flangeless wheels adapted to roll along one of said sets of parallel rails, guide means extending from said transfer car, said guide means adapted to engage said guide rail paralleling the set of support rails that the transfer car is rolling along in a manner such that the transfer car is laterally stable on the set of support rails.

The present invention also provides a pouring tank-transfer car assembly comprising a base frame, a tank body extending upward from said base frame, main roller means extending downward from said frame, said main roller means comprising at least three flangeless wheels adapted to roll along parallel tracks, and a guide assembly comprising a support extending outwardly from said frame and a guide means extending from said support, said guide means adapted to contact a guide rail.

DESCRIPTION OF THE PREFERRED EMBODIMENT

Figure 1:
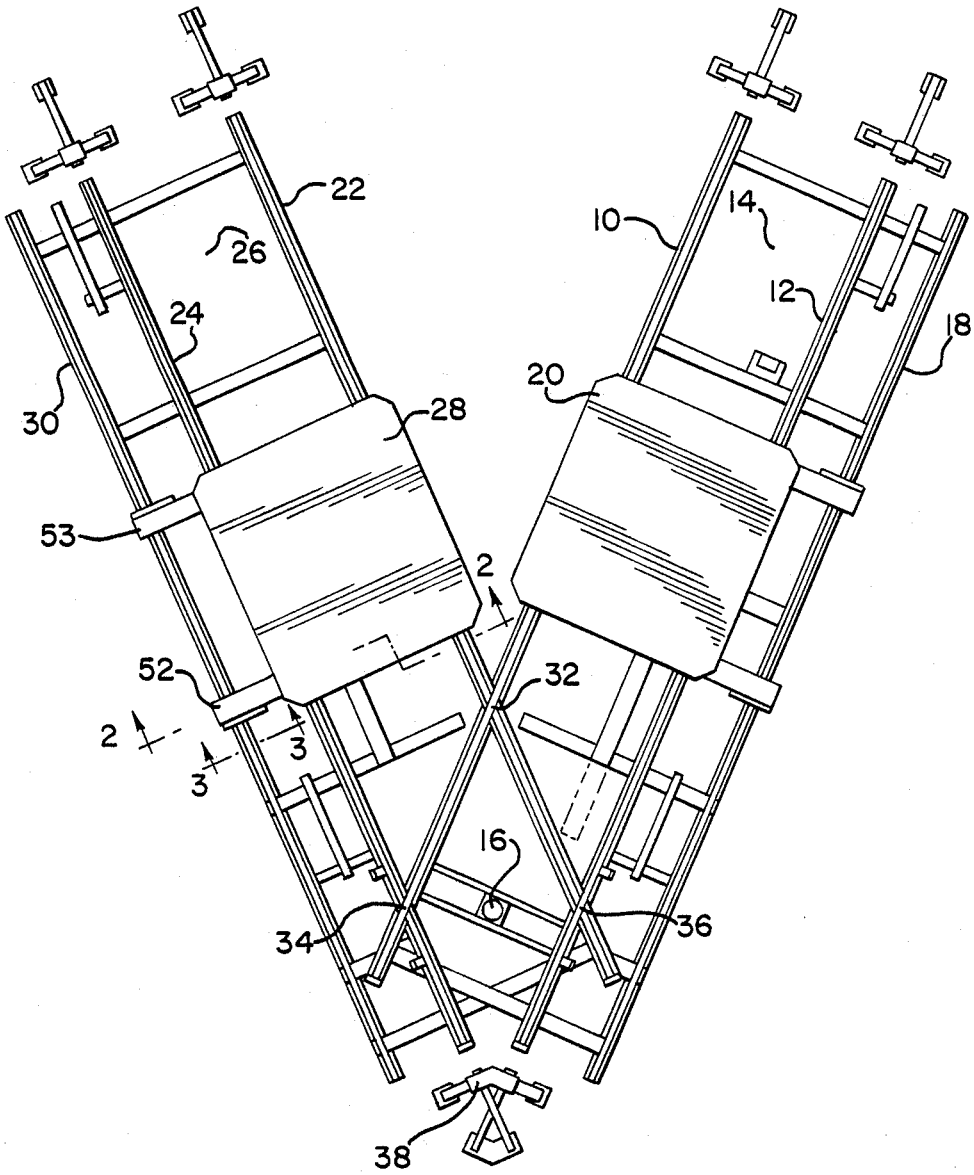
FIG. 1 is a plan view of the pouring tank assembly and tracks of the present invention.

Referring now to FIG. 1, a first set of two parallel rails 10 and 12 is shown as extending from a first loading station 14 to pouring station 16. A third or guide rail 18 parallels rails 10 and 12, to the outside thereof. A pouring tank-transfer car is shown at 20.

A second set of two parallel rails 22 and 24 is shown as extending from a second loading station 26 to pouring station 16. The first and second set of rails form an acute angle whose vertex is at pouring station 16. A third or guide rail 30 parallels rails 22 and 24, to the outside thereof. A pouring tank-transfer car is shown at 28.

Rails 10 and 22 cross or intersect at 32, rails 10 and 24 intersect at 34 and rails 12 and 22 intersect at 36. No gaps are present at any such intersections; the rails form an X-shaped joint. Third rails 18 and 30 do not cross. A bumper or car stop 38 is at the end of the rail sets at the pouring station.

Figure 2:
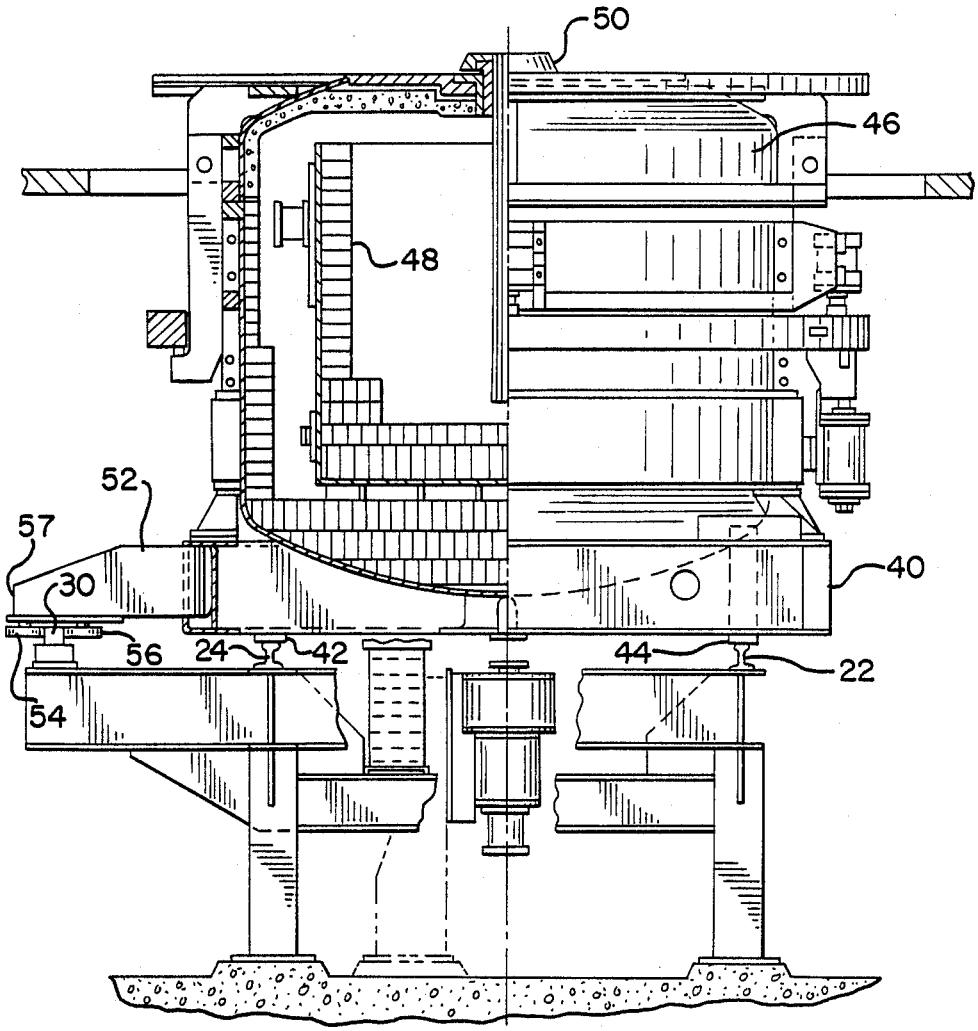
FIG. 2 is a side view in partial cross section of the pouring tank assembly and tracks of the present invention along lines 2—2 of FIG. 1.
Figure 3:
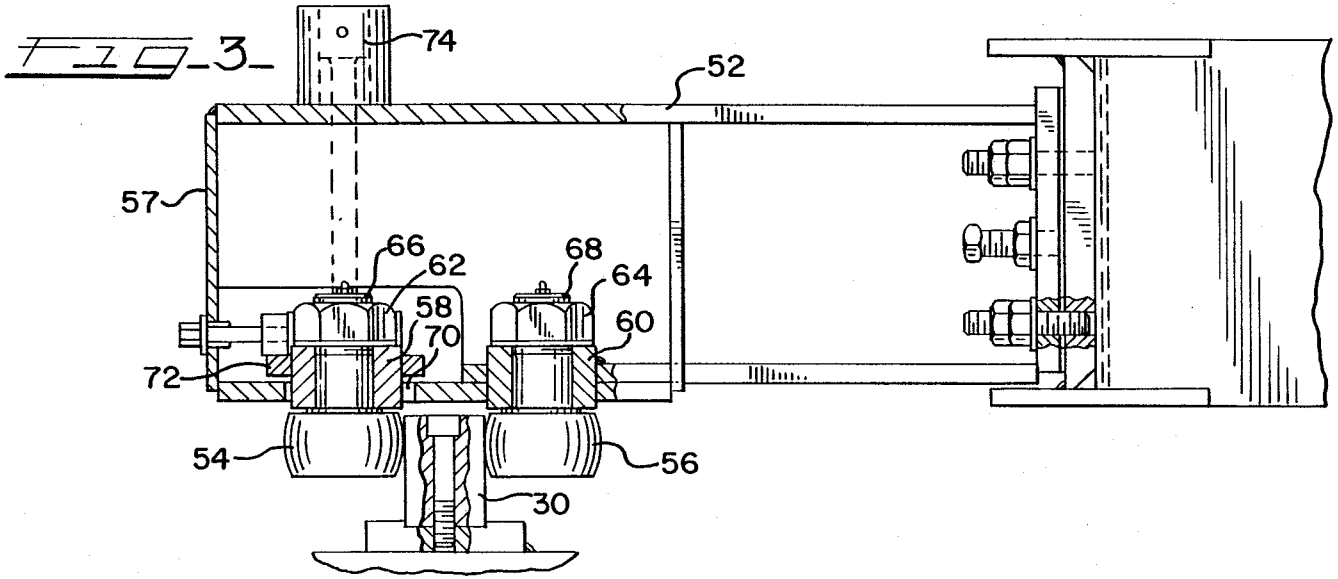
FIG. 3 is a detailed cross section view of the pouring tank-transfer car support arm of the present invention along lines 3—3 of FIG. 1.

Referring now to FIGS. 2 and 3, a side view of the pouring tank-transfer car 28 is shown. Transfer car 20 is identical, but is turned to accommodate third rail 18 for tracks 10 and 12. Transfer car 28 is comprised of a frame base 40 of structural steel in a generally rectangular arrangement. Extending from and supported in the lower levels of base 40 are two front wheels 42 and 44 and two rear wheels (not shown). These wheels are usually made of steel and are flangeless. The wheels of car 28 are supported on the two rails 24 and 22. A generally cylindrical pouring tank 46 is adapted to be supported by transfer car frame 40. Ladle 48 rests within pouring tank 46. Both ladle 48 and tank 46 are lined with a refractory material to permit the ladle to hold molten metal. Pouring tube 50 extends downward through the cover of the pouring tank into ladle 48.

Figure 4:
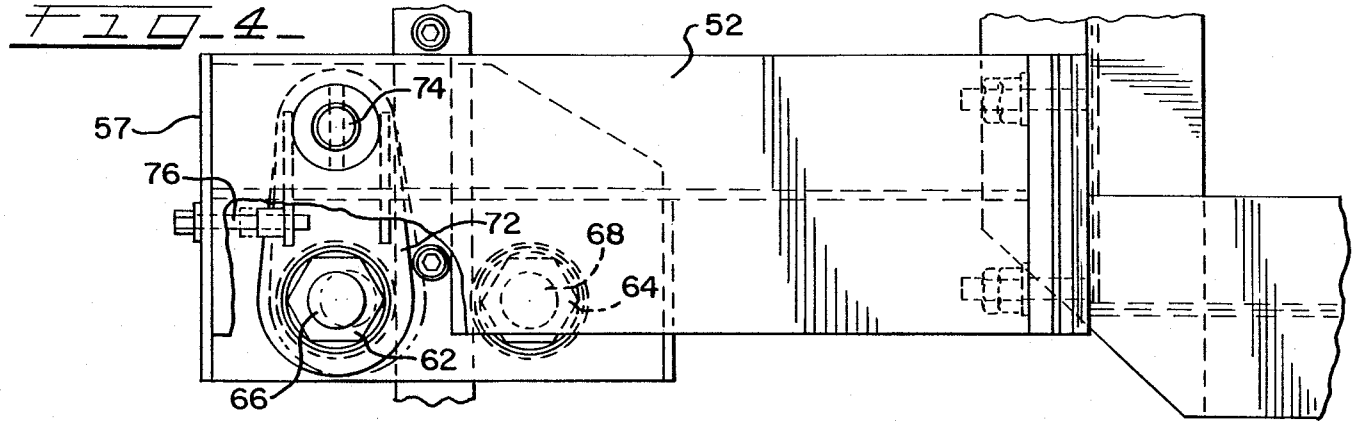
FIG. 4 is a top view of the pouring tank-transfer car support arm in partial cross section.

Extending outwardly from frame 40 are support arms 52 and 53. Support arm 52 is of a beam shape and structure and contains guide means such as rollers 54 and 56 suspended downwardly therefrom near its end 57. Rollers 54 and 56 are spaced apart to receive guide rail 30 therebetween. Support arm 53 has similar rollers. Roller 56 is suspended from a throughbolt 68 extending through spacer 60 and is held in place by hexagonal nut 64. Roller 54, as seen in FIGS. 3 and 4, is suspended from a throughbolt 66 extending through spacer 58. Spacer 58 is able to move laterally in opening 70 due to lateral adjusting bolt 76 and the support of plate 72 which surrounds spacer 58 and extends to bolt 74 which holds plate 72 in place. The lateral movement of spacer 58 as controlled by the opening size 70 permits roller 54 to be tightly fit against guide rail 30 thereby providing lateral stability to transfer car 28. Alternately either or both rollers 54, 56 may be replaced by guide means comprised of shoes which may slide against the sides of guide rail 30.

What is claimed is:

1. A pouring tank and track transfer assembly comprising:

a first set of parallel support rails and a first guide rail paralleling said first set of parallel support rails, a second set of parallel support rails and a second guide rail paralleling said second set of parallel support rails, said first and second set of parallel support rails intersecting at one or more locations said support rails abutting one another at said locations without gaps being formed therein, and said first and second guide rails are located at opposite outward sides of said first and second sets of support rails so as to not intersect each other or said first and second sets of support rails, and a pouring tank for molten metal mounted on a transfer car having two sets of parallel flangeless wheels adapted to roll along one of said sets of parallel support rails, and having guide means extending from only one side of said transfer car toward the respective outward guide rail, said guide means adapted to positively engage outward and inward sides of said guide rail paralleling the set of support rails that the transfer car is rolling along in a manner such that the transfer car is thereby held laterally stable on the set of support rails.

2. The pouring tank-transfer assembly of claim 1 wherein said guide means comprises a support extending outward from one side of said pouring tank, and rollers extending from said support, said rollers being spaced apart to receive said guide rail therein thereby preventing the lateral displacement of said pouring tank from said pair of parallel rails.

3. The pouring tank-transfer assembly of claim 1 wherein said guide means comprises a support extending outward from one side of said pouring tank, and shoes extending from said support, said shoes being spaced apart to receive said guide rail therein thereby preventing the lateral displacement of said pouring tank from said pair of parallel rails.

* * * * *